US005358023A

United States Patent [19]

Owens

[11] Patent Number: 5,358,023

[45] Date of Patent: Oct. 25, 1994

[54] ELECTRICALLY OPERATED EXPANDABLE JAMB FOR OPERABLE WALLS

[75] Inventor: N. Douglas Owens, Lynn, Ind.

[73] Assignee: Modernfold, Inc., New Castle, Ind.

[21] Appl. No.: 27,377

[22] Filed: Mar. 8, 1993

[51] Int. Cl.[5] ..... E05D 15/26

[52] U.S. Cl. ..... 160/199; 160/40; 160/188

[58] Field of Search ..... 160/199, 196.1, 206, 160/40, 188

[56] References Cited

U.S. PATENT DOCUMENTS

| | | | |
|---|---|---|---|
| 3,071,184 | 1/1963 | Peel | 160/40 |
| 3,090,342 | 5/1963 | Kummerman et al. | 114/202 |
| 3,092,065 | 6/1963 | Kummerman | 114/202 |
| 3,103,246 | 9/1963 | Brodsky | 160/188 |
| 3,155,068 | 11/1964 | Kummerman | 114/203 |
| 3,180,302 | 4/1965 | Hamilton | 114/203 |
| 3,332,472 | 7/1967 | Wiegand | 160/188 |
| 3,380,506 | 4/1968 | Good et al. | 160/199 |
| 3,414,040 | 12/1968 | Harris | 160/188 |
| 3,421,471 | 1/1969 | Richter | 114/202 |
| 3,448,786 | 6/1969 | Edgerton | 160/199 |
| 3,570,577 | 3/1971 | Bedrin et al. | 16/188 |
| 3,614,974 | 10/1971 | Tajima | 160/188 |
| 3,802,480 | 4/1974 | Daggy | 160/40 |
| 4,157,845 | 6/1979 | Queveau | 296/137 D |
| 4,860,813 | 8/1989 | Ballyns et al. | 160/188 |

OTHER PUBLICATIONS

Acousti-Seal 963E Series Electrically Operated Operable Gymnasium Wall Brochure, Modernfold, Inc. Form No. 2248, 1991.

Acousti-Seal Operable Partitions Brochure, Modernfold, Inc., Form No. 2235, 1991.

*Primary Examiner*—David M. Purol

*Attorney, Agent, or Firm*—Baker & Daniels

[57] ABSTRACT

An electrically actuated, expandable wall jamb for an operable wall system. The expandable jamb includes a first wall section having an inward edge for connection to a stationary wall and an outward edge opposite the inward edge. The jamb also includes a second wall section slidably movable with respect to the first wall section. The second wall section includes a sealing edge for sealing engagement with a vertical structure and is movable between a retracted position in which the sealing edge is proximate the outward edge of the first wall section and a sealed position in which the sealing edge extends outward from the outward edge of the first section. The expandable jamb also includes an actuator movable between a first position and a second position connected to both the first and second wall sections and a motor connected to the actuator such that operation of the motor causes the actuator to move between its first and second positions, thereby resulting in movement of the second wall section between its retracted and expanded positions, respectively. Use of the jamb results in an operable wall system which serves as a sound and light barrier between the rooms which the system divides and assists in flattening the wall panels. The jamb may also include a mechanism for sensing the pressure the jamb exerts on the surface in its expandable position, sealingly engages to result in a good seal and to avoid potential damage to the expansion mechanism, the wall panels or the walls.

15 Claims, 8 Drawing Sheets

ELECTRICALLY OPERATED EXPANDABLE JAMB FOR OPERABLE WALLS

1. Field of the Invention

This invention relates to operable wall panel systems, and, in particular, to the provision of an expandable wall jamb therefor.

2. Description of the Related Art

Operable wall panels are used to divide a large room into two or more smaller areas, including the division of gymnasium, a large conference room, training facilities and conference centers into smaller rooms. Operable wall systems are generally supported by a track located in the ceiling and may also include a floor support system. In some installations, the wall panels are manually moved into position and, in other installations, several wall panels may be hingedly connected to each other and traverse the track via the provision of electric power. When operable wall panels are extended between two existing walls to form another wall therebetween, it is desired that the wall panels form a straight line, that there be no gaps between the panels, and that there be no gaps between the walls and those panels abutting the walls. This is particularly important when the consumer is interested in a room divider, an operable wall system, which does not allow sound or light to permeate through the operable wall panels. Thus, most operable wall systems also include jambs which are rigidly affixed to existing walls. A leading wall jamb and a trailing wall jamb are usually provided. The trailing wall jamb is connected to the trailing wall, the wall nearest the wall panels when the wall panels are in their stored, stacked, or retracted position. The leading wall jamb is connected to the leading wall, the wall toward which the panels are moved to form a wall dividing the room. When the wall panels form this dividing wall, the wall panels are said to be in their extended position.

Though the jambs provide a better seal than can be accomplished should the wall panels be made to directly contact the trailing and leading walls, gaps between the panels close to the jambs and the jambs still result. The presence of these gaps is not only detrimental to the capability of the operable wall panel system to be used as a sound and/or light barrier, but also does not assist in making certain that the operable wall panels are in a straight line. Therefore, it is desired to provide a jamb for use with operable wall panels which forms a good seal with the panel which engages the jamb such that neither sound nor light may emanate between the jamb and the panel. It is also desired to provide a jamb for use with an operable wall panel system which results in the formation of a flat wall.

To compensate for the gaps created between the operable walls and the rigidly affixed jambs, it is known in the art to provide an expandable wall panel which generally comprises the trailing wall panel. Once the operable wall system is in its extended position, the expanding mechanism of the expandable wall panel is engaged to increase the width of the expandable wall panel thereby closing any gaps between the operable wall panels themselves as well as closing the gaps between the jambs and the leading and trailing panels. These expandable wall panels incorporate manually actuated mechanical mechanisms. Some of the earlier expandable wall panels were of a configuration that tended to result in sagging of the expanded portion of the expandable wall portion. This sagging meant that the exposed edge of the expanded portion was not vertical in all instances and therefore could result in gaps between the expandable wall panel and the adjacent wall or jamb. Improvements to the mechanical actuators were made to reduce or eliminate the problem of sagging encountered with earlier systems, such as by the addition of a rack and pinion mechanism.

Though the problem of sagging and the insufficient seal resulting therefrom has been addressed, the manually actuated expandable wall panels have generally only been provided with manually operated operable wall panel systems. Attempts have been made to incorporate such an expandable wall panel with an electrically driven operable wall panel system; however, the inconvenience of manually adjusting the expandable wall panel for such electrically driven systems has not been well received. Therefore, it is desired to provide an electrically actuated expandable wall panel or jamb which results in a good seal between the adjacent vertical surface and which also assists in flattening the panels of the operable wall system when the panels are in their extended position.

A potential problem in the utilization of expandable wall panels or jambs is the determination by the user of the sufficient amount of expansion necessary to result in a good seal between it and the adjacent surface. It is plausible that over extension of the expandable portion of the wall or jamb may result in damage to the expanding mechanism or that the expandable portion is insufficiently extended to result in a good seal. Therefore, it is desired to provide an expandable wall panel or jamb having mechanism which ensures that the expandable portion is extended a proper distance so as to result in a good seal with its adjacent surfaces and to limit the potential damage to the expanding mechanism, to wall panels or to walls via over extension of the expandable portion.

For electrically driven wall panel systems suspended from a ceiling, the wall panels of the system are connected to each other via hinges, cables and the like. Application of a force against the sides of a wall panel when the panels are extended to form a dividing wall may cause a break in the flatness of the wall. This is due, in part, to the fact that the leading and trailing panels are not rigidly affixed to either the leading and trailing jambs or the leading and trailing walls. To compensate for this potential breaking of the walls by application of an inadvertent force thereto, electrically driven wall panel systems often include a floor support system which inhibits inadvertent breaking of the wall. Such floor support systems add cost to operable wall systems and detract from its aesthetic appearance. If the wall panels of an electrically driven, continuously hinged operable wall system were sufficiently sealed against each other and against the leading and trailing jambs or walls, the requirement for such floor support systems could be minimized or eliminated. Therefore, it is desired to provide an expandable jamb or wall panel for an electrically driven, continuously hinged operable wall system that minimizes or eliminates the requirement for a floor support system in addition to the ceiling support system from which the operable wall panels are suspended.

When providing an electrically actuated mechanism, it is generally desired to provide a means by which the mechanism may be operated in the event of a power loss or a malfunction of any of the electrical and/or mechanical components of the mechanism. Thus, it is also desired that an electrically actuated expandable jamb include a means by which the expandable jamb may be expanded or retracted in the event that power is inadvertently disconnected or unavailable and in the event the driving motor is not functioning properly.

SUMMARY OF THE INVENTION

The present invention provides an electrically operated, expandable jamb to be used in connection with operable wall systems.

The invention comprises, in one form thereof, a jamb having a first wall section for connection to a stationary wall, a second wall section slidably movable with respect to the first wall section, an actuator connected to the first and second wall sections, and a motor operatively connected to the actuator. The first wall section has first and second opposing surfaces and an outward edge, the outward edge disposed opposite the stationary wall. The second wall section includes a sealing edge and first and second opposing surfaces substantially parallel with the first and second opposing surfaces of the first wall section. The second wall section is movable between a retracted position in which the sealing edge is proximate the outward edge of the first wall section and a sealed position in which the sealing edge is extended away from the outward edge of the first wall section for sealing engagement with a vertical structure disposed away from the sealing edge when the second wall section is in its retracted position. The actuator, which is responsive to the operation of the motor to which it is connected, moves between a first position and a second position such that when the actuator is in the first position, the second wall section is in the retracted position and such that when the actuator is in the second position, the second wall section is in the sealed position.

In another form thereof, the expandable jamb further comprises a means for sensing the pressure exerted on the sealing edge of the second wall section. The sensing means is connected to the motor such that power to the motor may be disconnected when the pressure sensing means reaches a predetermined threshold. Coupled with such a pressure sensing means may also be a means for setting the predetermined threshold. In one embodiment, the pressure sensing means comprises a means for measuring the current of the motor.

In yet another form thereof, the invention comprises an operable wall system for disposition in a room having a ceiling and two opposing wall surfaces. The operable wall system includes a track operatively connected to the ceiling, disposed between the room's opposing wall surfaces and defining a track path, a plurality of wall panels operatively connected to and movable along the track path, and the expandable jamb according to the present invention wherein the jamb is connected to one of the opposing wall surfaces. In one embodiment thereof, the wall panels are hingedly connected to each other and the operable wall panel system also includes an electrically powered drive mechanism operatively connected to one or more of the wall panels, the drive system capable of moving the wall panels along the track path.

An advantage of the present invention is the provision of an expandable wall portion for an operable wall system which results in a good seal, one serving as a good sound and light barrier, with the adjacent surface engaged by the expandable wall portion.

Another advantage of the present invention is the provision of an expandable wall portion for an operable wall system which assists in flattening the wall panels when in their extended position.

Yet another advantage of the present invention is the provision of a mechanism for determining the proper distance of expansion of an expandable wall portion for an operable wall panel system to result in a good seal with its adjacent surfaces to limit the potential damage to the expansion mechanism, to wall panels or to walls via over extension of the expansion portion.

Still another advantage of the present invention is the provision of an automatic expandable wall portion which, when used in conjunction with an electrically driven, continuously hinged operable wall system, requires minimal or no floor support for maintenance of a flat wall when the panels are in their extended position in the event an inadvertent force is applied against one or more of the wall panels.

Another advantage of the present invention is the provision of an electrically powered expandable wall portion which may be manually expanded or retracted in the event power to the jamb is unavailable or in the event the driving motor is not functioning.

BRIEF DESCRIPTION OF THE DRAWINGS

The above-mentioned and other features and advantages of this invention, and the manner of attaining them, will become more apparent and the invention will be better understood by reference to the following description of the following embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figure 1:
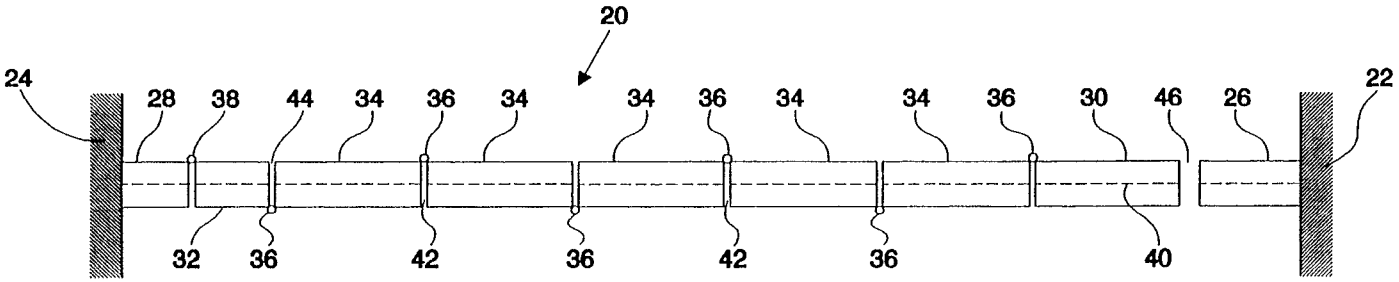
PRIOR ART Fig. 1
FIG. 1 shows a diagrammatic top view of one embodiment of an operable wall system which utilizes leading and trailing jambs which represent prior art.

Referring now to FIG. 1, there is shown a diagrammatic top view of one embodiment of an operable wall system which utilizes leading and trailing jambs which represent prior art. In this embodiment, operable wall system 20 resides between first, or leading, wall 22 and second, or trailing, wall 24. Rigidly affixed to leading wall 22 is leading jamb 26 and rigidly affixed to trailing wall 24 is trailing jamb 28. Wall system 20 comprises leading wall panel 30, trailing wall panel 32 and intermediate wall panels 34, all connected to each other via hinges 36. Trailing jamb 28 of this embodiment is hingedly coupled to trailing panel 32 via jamb hinge 38. To move wall system 20 from its retracted position (not shown), wherein wall panels 30, 32 and 34 are stacked near trailing jamb 28, to its extended position as shown in FIG. 1, they are moved along track path 40.

As is well known in the art, wall panels 30, 32 and 34 are suspended from a track residing in the ceiling of the room and from which panels 30, 32 and 34 are suspended by dolleys. Often, such continuously hinged wall systems are electrically actuated, i.e., a motor is operatively connected to one of more of panels 30, 32 or 34, usually leading panel 30, to cause panels 30, 32 and 34 to move along track path 40. As shown in FIG. 1, once panels 30, 32 and 34 are in their fully extended position, panel gaps 42 between adjacent wall panels are minimal as is the trailing jamb gap 44 between trailing jamb 28 and trailing panel 32. However, to permit panels 30, 32 and 34 to move into the fully extended position, leading gap 46 is of significant width to result in an insufficient seal between leading panel 30 and leading jamb 26. Thus, the use of trailing jamb 28 hingedly connected to trailing panel 32 results in an insufficient sound and light barrier between leading panel 30 and leading jamb 26.

Figure 2:
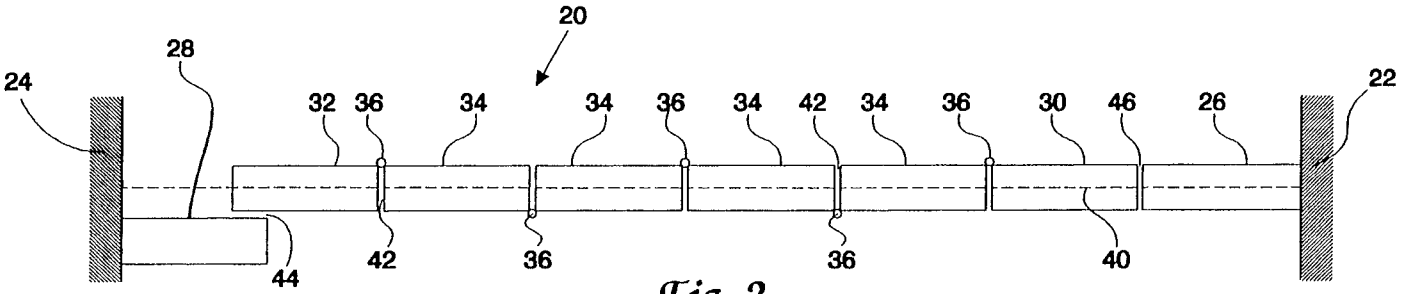
PRIOR ART Fig. 2
FIG. 2 shows a diagrammatic top view of a second embodiment of an operable wall system which utilizes leading and trailing jambs which represent prior art.

FIG. 2 shows a diagrammatic top view of a second embodiment of an operable wall system which utilizes leading and trailing jambs which represent prior art. In this embodiment, the width of leading gap 46 has been reduced by not requiring that trailing panel 32 be connected to trailing jamb 28 and by permitting panels 30, 32 and 34 to travel track path 40 from which trailing jamb 28 is offset. While panel gaps 42 and leading gap 46 are minimal, trailing gap 44 is insufficient for wall system 20 to serve as a good sound and/or light barrier between the areas it divides.

Figure 3:
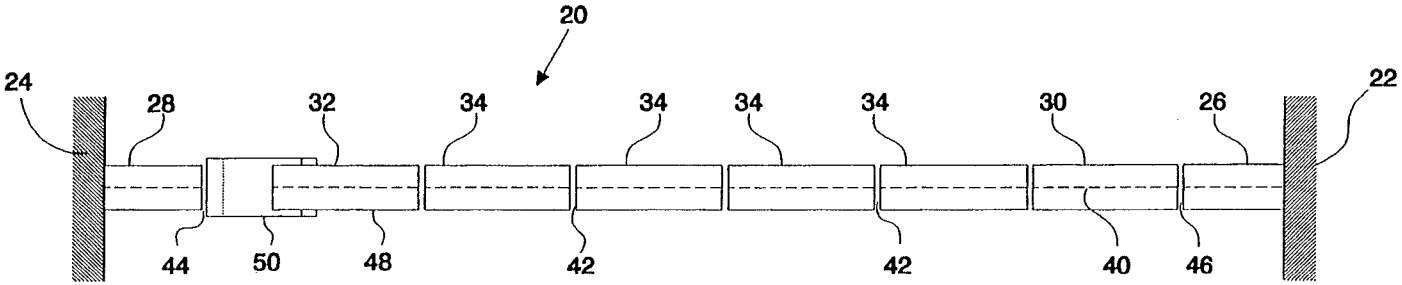
PRIOR ART Fig. 3
FIG. 3 shows a diagrammatic top view of one embodiment of a manually operated operable wall system having an expandable wall panel which represents prior art.

FIG. 3 shows a diagrammatic top view of one embodiment of a manually operated operable wall panel system having an expandable wall panel which represents prior art. Panels 30, 32 and 34 of this embodiment are not hingedly connected to each other and, thus, are of the type to be manually moved into position along track path 40. Trailing panel 32 of this embodiment includes mechanically actuated expandable wall portion 48 which is slidably movable with respect to stationary wall portion 50 of trailing panel 32. During operation, once wall panels 30, 32 and 34 have been moved to their extended position along track path 40, expandable wall portion 48 is mechanically actuated by mechanism such as a rack and pinion such that expandable wall portion 50 moves toward trailing jamb 28 to minimize panel gaps 42, trailing gap 44 and leading gap 46.

It will be appreciated by those of skill in the art that improvements to the operable wall systems illustrated in FIGS. 1–3 are desired. With regard to electrically actuated wall systems as shown in FIGS. 1–2, the utilization of fixed leading and trailing jambs 26 and 28 results in a gap between the one or more of the fixed jambs and the leading and/or trailing panel. Also, panels 30, 32 and 34 are shown as being in an alignment which results in a flat wall; however, in many instances it is actually difficult to create such a flat wall with such systems.

Though the expandable wall panel shown in FIG. 3 results in a better seal between the wall panels and the jambs, manually actuated expandable wall panels are not practical for use with an electrically driven system in which it is expected that the operation of the wall, during both extension and retraction of the wall panels, be fully automatic and electrically powered.

Figure 4:
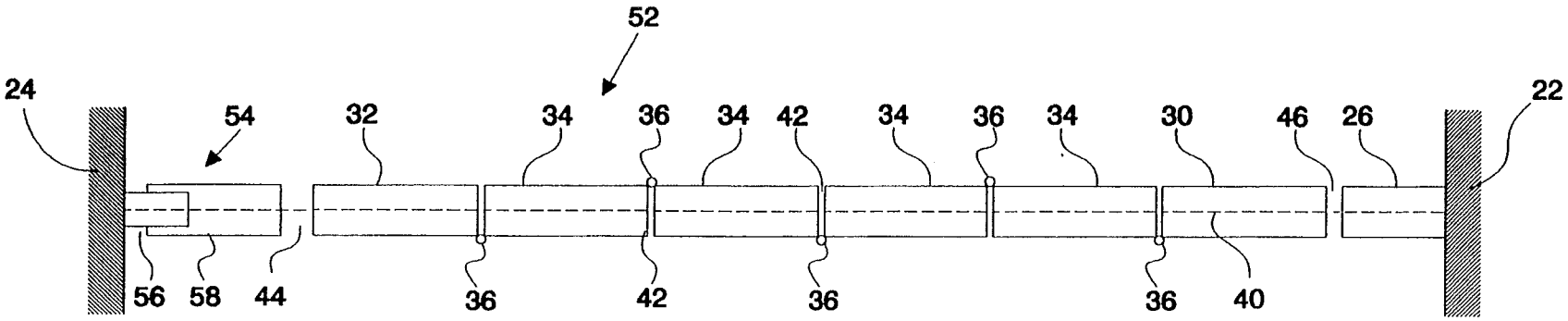
FIG. 4 shows a diagrammatic top view of one embodiment of an operable wall system according to the present invention in which the expandable jamb has not yet been extended.
Figure 5:
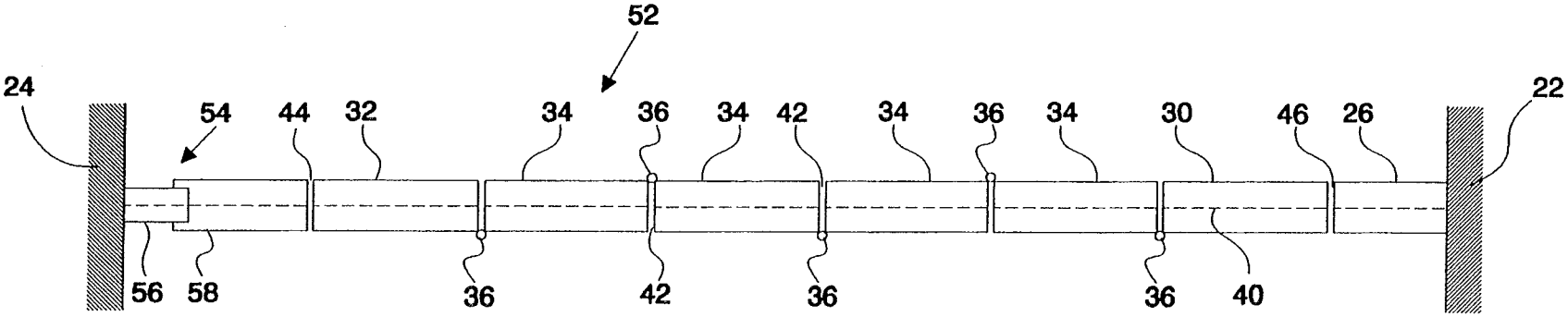
FIG. 5 shows a diagrammatic top view of the embodiment of FIG. 4 in which the expandable jamb has been extended.

Referring to FIGS. 4 and 5, there are shown diagrammatic top views of one embodiment of an operable wall system according to the present invention. In this embodiment, operable wall system 52 includes leading panel 30, trailing panel 32, and intermediate panels 34 connected to each other via hinges 36. Operable wall system 52 also includes fixed leading jamb 26 and expandable jamb 54. Expandable jamb 54 includes first and second wall sections 56 and 58 with first wall section 56 connected to trailing wall 24 and second wall section 58 slidably movable along track path 40 with respect to first wall section 56. Thus, when panels 30, 32 and 34 are initially extended as shown in FIG. 4 and expandable second wall section 58 of expandable jamb 54 is in its retracted position as shown, panel gaps 42, trailing gap 44 and leading gap 46 may all be present. However, by actuating the mechanism within expandable jamb 54 (described in further detail herein) to cause second wall portion 58 to move to its extended or sealed position as shown in FIG. 5, panel gaps 42, trailing gap 44, and leading gap 46 are all minimized such that operable wall system 52 serves as a barrier to sound and light, as a good seal is present between each of the wall panels 30, 32 and 34, between expandable jamb 54 and trailing panel 32, and between leading jamb 26 and leading panel 30.

The expandable jamb according to the present invention not only results in an operable wall system which serves as a barrier to sound and light, but also assists in aligning the panels to form a flat wall as shown. It will be appreciated that expandable jamb 54 may be placed against leading wall 22 to accomplish the same intended results although, when placed against leading wall 22, additional modifications to the operable wall system will likely be necessary.

Figure 6:
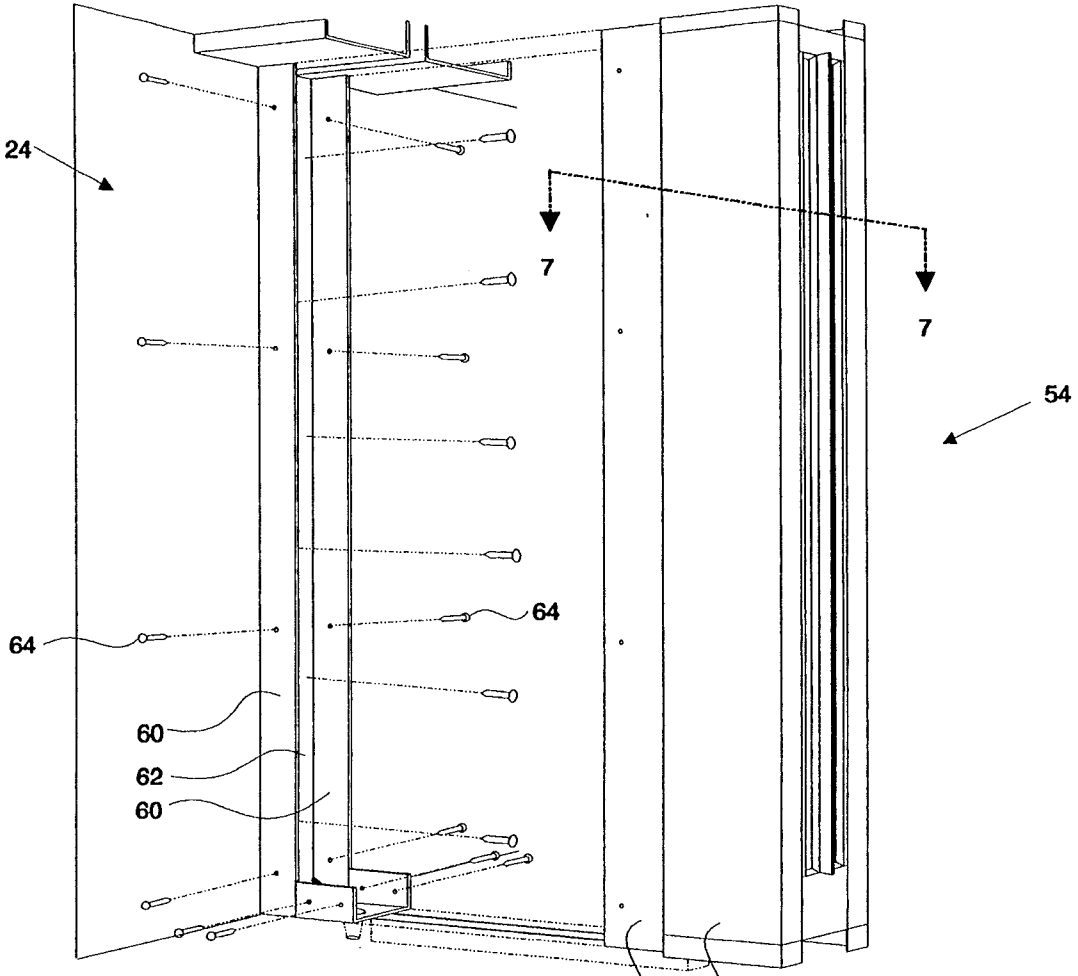
FIG. 6 shows a perspective view of one embodiment of the expandable jamb according to the present invention in which the expandable jamb has not yet been affixed to a wall.

Referring now to FIG. 6, there is shown a perspective view of one embodiment of the expandable jamb according to the present invention in which the expandable jamb has not yet been affixed to a wall. Affixed to trailing wall 24 are wall brackets 60 forming channel 62 for the receipt of s expandable jamb 54. Specifically, first wall portion 56 of expandable jamb 54 is slid over channel 62 formed by wall brackets 60, properly aligned, and connected via fasteners or screws 64 to wall brackets 60. In this manner, expandable jamb 54 may be placed in the appropriate vertical orientation, compensating for any deviation in the verticality of trailing wall 24.

Figure 7:
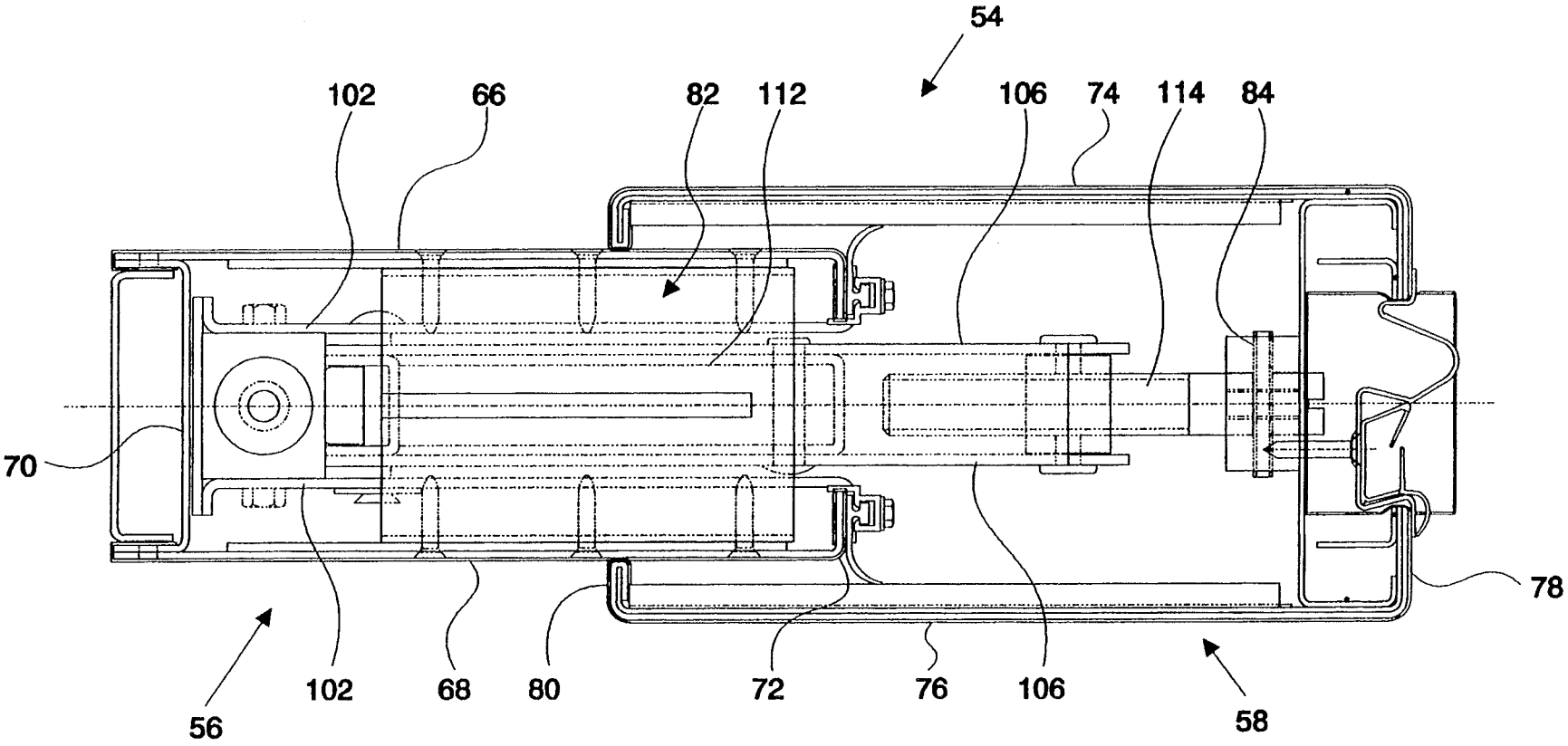
FIG. 7 shows a cross-sectional view of the expandable jamb of the embodiment of FIG. 6 at line 7—7.

FIG. 7 shows a cross-sectional view of the expandable jamb of the embodiment of FIG. 6 at line 7—7 in which the expandable jamb is in its extended position. Expandable jamb 54 includes first wall section 56 having first and second opposing surfaces 66 and 68, respectively, inward edge 70 for engagement with a stationary wall surface such as described above, and outward edge 72 opposite inward edge 70. Expandable jamb 54 also includes second wall section 58 slidably movable with respect to first wall section 56. Second wall section 58 has first and second opposing surfaces 74 and 76, respectively, which are substantially parallel with first and second opposing surfaces 66 and 68 of first wall section 56, inward edge 80 and sealing edge 78 for sealing engagement with a vertical structure, such as a wall panel, displaced beyond sealing edge 78 when expandable jamb 54 is in its retracted position as shown in FIG. 4. In its retracted position, sealing edge 78 of second wall section 58 is as close to outward edge 72 of first wall section 56 as actuator 82 will permit. When in its sealed position, as illustrated in FIG. 5, sealing edge 78 of second wall section 58 is extended away from outward edge 72 of first wall section 56 for sealing engagement s with a substantially vertical structure, such as trailing wall panel 32 illustrated in FIG. 5. In this embodiment, actuator 82 is connected to inward edge 70 of first wall section 56 and is connected via connector 84 to sealing edge 78 of second wall section 58. Actuator 82 lies between first and second opposing walls 66 and 68 of first wall section 56 and between first and second opposing walls 74 and 76 of second wall section 58 to be housed entirely within the exterior surfaces of expandable jamb 54.

For aesthetic reasons, location of actuator 82 within first and second wall sections 56 and 58 is desirable. Further, first and second opposing walls 66 and 68 of first wall section 56 and first and second opposing walls 74 and 76 of second wall section 58 may be made of or covered with a material or covering which matches the exterior surfaces of the wall panels of the operable wall system with which expandable jamb 54 is provided.

Figure 8:
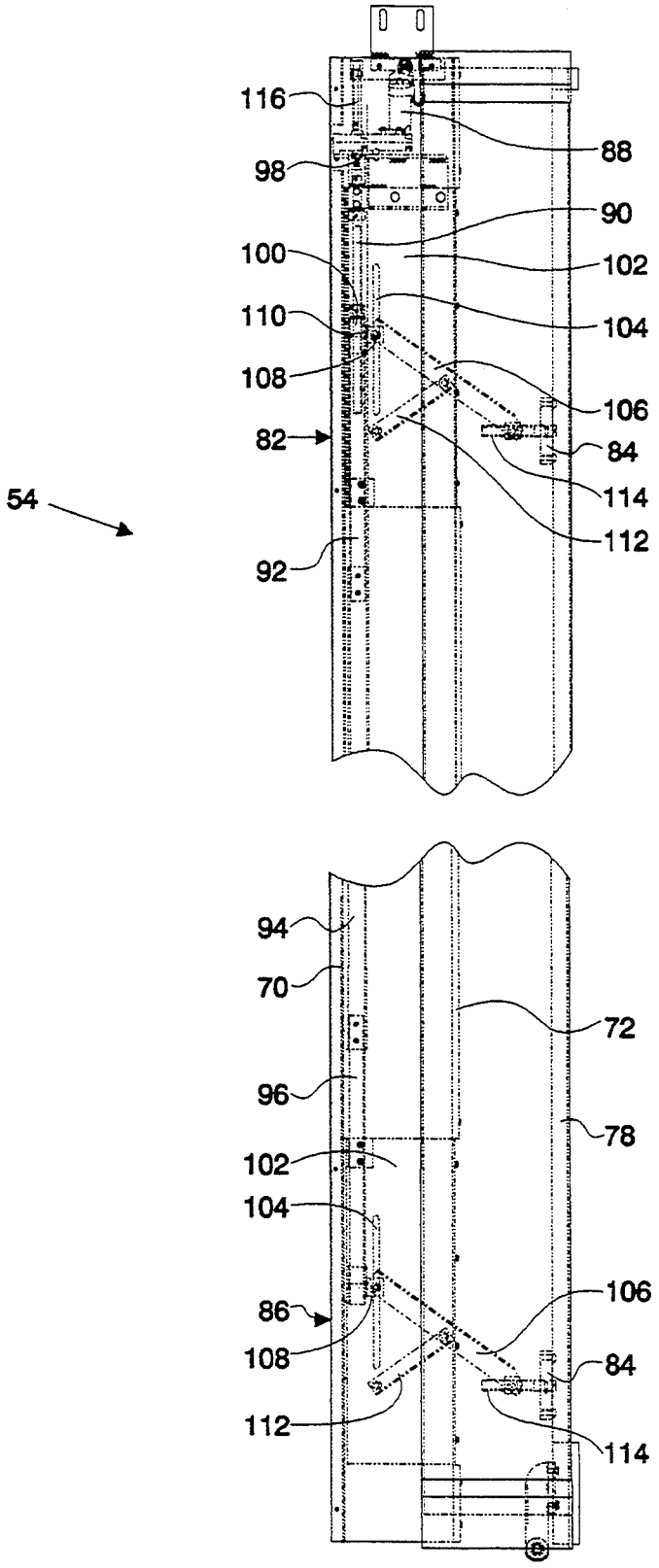
FIG. 8 shows a side view of one embodiment of the expandable jamb according to the present invention in which the actuators are in their second position and the expandable jamb is in its sealed position.

Referring to FIG. 8, there is shown a side view of one embodiment of the expandable jamb according to the present invention in which the expandable jamb is in its extended position. In this embodiment, two actuator mechanisms, first and second actuators 82 and 86, respectively, are installed within expandable jamb 54. First actuator 82 is operatively connected to gear motor 88 via threaded rod 90 and second actuator 86 is operatively connected to first actuator 82, and hence to motor 88, via first, second and third extension tubes 92, 94 and 96, respectively, which are rigidly connected to each other. Turning first to the connection of first actuator 82 to motor 88, motor 88, such as a 24 VDC reversible gear motor available from Howard Industries, Inc. of Milford, Ill, has motor shaft 98 to which threaded rod 90 is rigidly connected such that threaded rod 90 rotates in response to operation of motor 88. Threadedly attached to threaded rod 90 is square nut 100 which is attached to one end of first extension tube 92. First, second and third extension tubes 92, 94, and 96 are not permitted to rotate about their longitudinal axes as described herein. Thus, rotation of threaded rod 90 causes nut 100 to traverse the longitudinal axis of threaded rod 90 and causes extension tubes 92, 94 and is 96 to move in the same direction as nut 100.

As seen in both FIGS. 7 and 8, attached to first wall section 56 are actuator brackets 102, each having vertical slot 104 therethrough. First extension arm 106 is pivotally connected at one of its ends to first extension tube 92 via pivot fastener 108. Pivot fastener 108, such as a semi-tubular rivet, extends through tube bracket 110 connected to first tube 92 and through slots 104 of actuator brackets 102. First extension arm 106 is connected at its other end to connector 84. Also pivotally connected at one of its ends to actuator bracket 102 is second extension arm 112. Second extension arm 112 is pivotally connected at its other end to a point between the ends of first extension arm 106. The connection of first, second and third extension tubes 92, 94 and 96 to pivot fastener 108 prohibits first, second and third extension tubes 92, 94 and 96 from rotating about their longitudinal axes.

During operation, activation of motor 88 causes threaded rod 90 to rotate and nut 100 and first extension tube 92 to move along the longitudinal axis of threaded rod 90. Movement of first extension tube 92 in turn causes first actuator 82, including nut 100, first extension tube 92, first extension arm 106, second extension arm 112 and connector 84, to move between its first and second positions as are described in further detail herein. In general, movement of first extension tube 92 causes pivot fastener 108 to move within slots 104 of actuator brackets 102. Because first extension arm 106 is also connected to second extension arm 112, movement of pivot fastener 108 within slots 104 causes connector 84 to move horizontally with respect to sealing edge 78 of second wall section 58 to thereby cause either the retraction or extension of second wall section 58.

Preferably, second actuator 86 comprises essentially the same components as first actuator 82, namely, nut 100 (shared in common with nut 100 of first actuator 82), extension tubes 92, 94 and 96, first extension arm 106, second extension arm 112 and connector 84. Also, first extension arm 106 of second actuator 86 is connected to third extension tube 96 in the same manner that first extension arm 106 of first actuator 82 is connected to first extension tube 92. Therefore, manufacturing costs are minimized by providing an expandable jamb wherein all actuators are comprised of many identical components.

Figure 9:
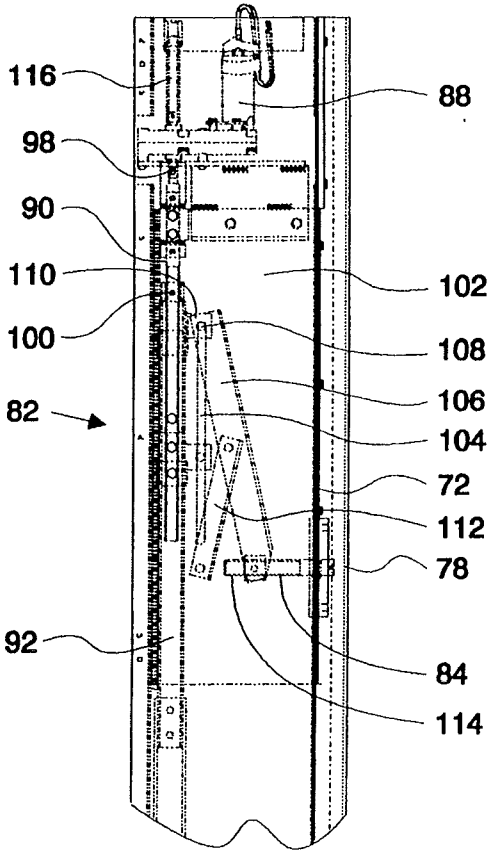
FIG. 9 shows a partial side view of the first actuator of the embodiment of FIG. 8 in which the first actuator is in its first position and the expandable jamb is in its retracted position.

In FIG. 8, first and second actuators 82 and 86 are in their second position such that sealing edge 78 of second wall section 58 is in its sealed position, illustrated above in FIG. 5, for sealing engagement with a vertical wall surface. FIG. 9 shows first actuator 82 in its first position wherein second wall section 58 is in its retracted position as also illustrated in FIG. 4. To move second wall section 58 between its retracted position to its sealing position, first and second actuators 82 and 86 are caused to move from their first to their second position by rotation of threaded rod 90 by motor 88 in a counter-clockwise direction as viewed from motor 88. When second wall section 58 is in its sealed position, clockwise rotation of threaded rod 90 by motor 88 causes movement of first and second actuators 82 and 86 from their second position to their first position to cause second wall section 58 to move from its sealed positions as shown in FIGS. 8 and 5, to its retracted position, as shown in FIGS. 9 and 4.

In this embodiment, connector 84 attached to sealing edge 78 of second wall section 58 and actuators 82 and 86 includes adjustment mechanism 114 for adjusting the distance second wall section 58 may be extended away from first wall section 56. For example, adjustment mechanism 114 may comprise a tube having a slot through its longitudinal axis for the acceptance of a rivet therethrough. Alternatively, adjusting mechanism 114 may comprise a threaded rod such that a nut pivotally connected to first extension arm 106 may threadedly engage the threaded rod and be positioned at various positions along the threaded rods longitudinal axis.

It will be appreciated by those of skill in the art that the number of actuators required for an expandable jamb according to the present invention may vary. For an operable wall system comprising very tall wall panels, more than two actuators may be desired to ensure that the expandable portion of the expandable jamb, specifically, sealing edge 78 of second wall section 58, remains vertical during movement between the retracted and sealed positions of the expandable jamb and pressure exerted is by sealing edge 78 remains constant along sealing edge 78.

FIGS. 8 and 9 also illustrate socket extension rod 116 extending above motor 88. In this embodiment, gear motor 88 is of the type providing the attachment of a shaft to motor 88 above and/or below motor 88, such that operation of motor 88 causes a shaft connected above and/or below motor 88 to be rotated. Thus, in addition to connecting threaded rod 90 to motor 88 below motor 88, socket extension rod 116 is connected to motor 88 above motor 88 in this embodiment. The provision of socket extension rod 116 allows one to expand or retract second wall section 58 manually, such as may be desired in the event power to motor 88 is unavailable or disconnected or in the event motor 88 is not functioning properly. By simply rotating socket extension rod 116, threaded rod 90 is caused to rotate, and thereby move first and second actuators 82 and 86 accordingly as previously described when electrical power is provided to first and second actuators 82 and 86.

Figure 10:
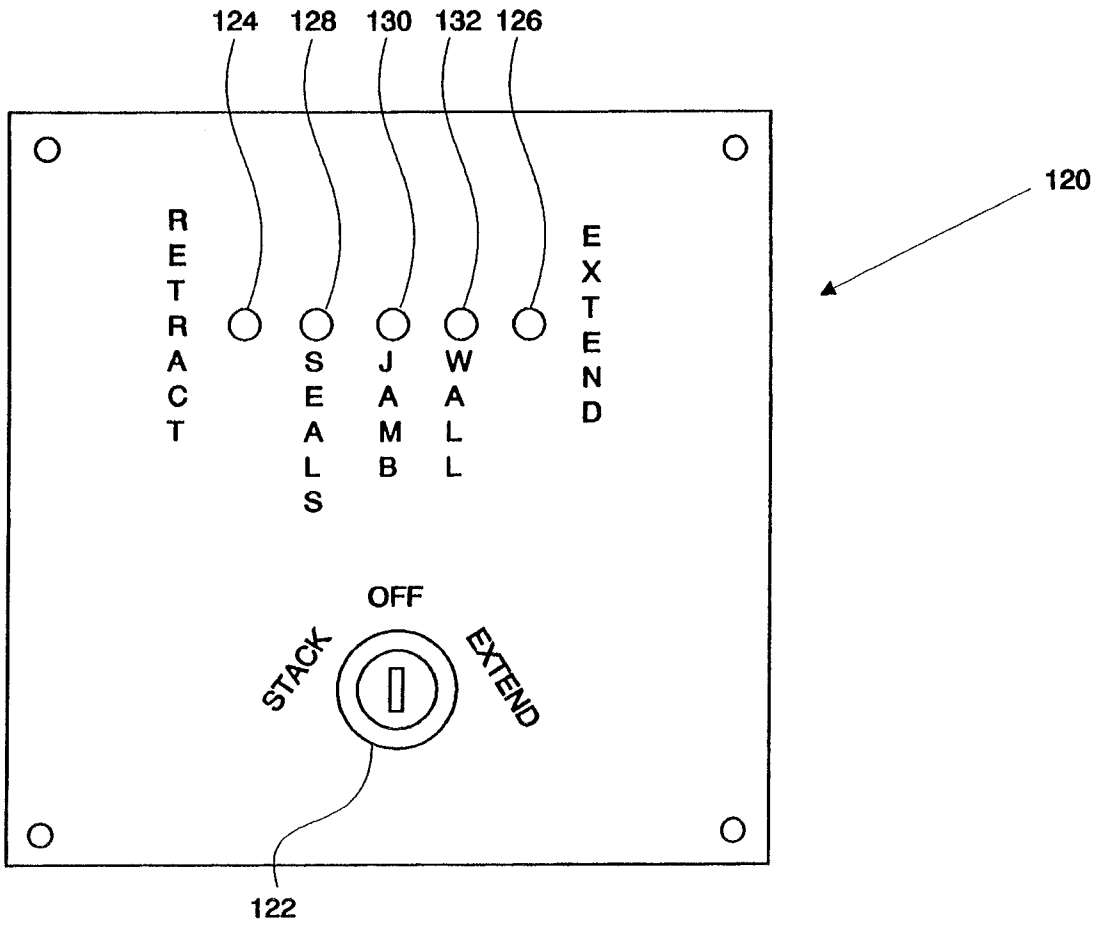
FIG. 10 shows a front view of one embodiment of the electronic control box used with the expandable jamb according to the present invention.

FIG. 10 shows a front view of one embodiment of the electronic control box used with the expandable jamb according to the present invention. Control box 120 is intended for use with an electrically driven, continuously hinged wall system employing the expandable jamb according to the present invention as well as an electrically actuated drop seal as is disclosed in a copending patent application assigned to the assignee herein. Such a drop seal is not, however, essential to the operation of an expandable jamb according to the present invention. Control box 120 includes key switch 122 movable between three positions designated as OFF, STACK and EXTEND. When key switch 122 is in the OFF position, power to motor 88 is disconnected. When key switch 122 is placed in the STACK position, the driving motor (not shown) of the operable wall system causes the wall panels to move toward their stacked, or stored, position. When key switch 122 is placed in the EXTEND position, the driving motor of the operable wall system causes the wall panels to move toward their extended position wherein the wall panels form a wall. Such electric control of operable wall panels to cause the panels to be stacked or extended is well known in the art.

Control box 120 also includes retract LED (light-emitting diode) 124, extend LED 126, seals LED 128, jamb LED 130 and wall LED 132. These are status LEDs indicating the current status of the wall panels, drop seals, expandable jamb, and wall panels. Specifically, if the wall panels of the operable wall system are in their stacked position and are to be extended, by placing key switch 122 in the EXTEND position, extend LED 126 is lit and power is provided to the wall panel driving motor. As the wall panels begin to move, wall LED 132 is lit. Once the wall panels reach the extended position, the wall LED 132 is no longer lit, the power to the wall panel driving motor is disconnected, and the expandable jamb of the present invention may be activated toward its sealed position as described herein. Jamb LED 130 is lit during the movement of the expandable jamb from its retracted position to its sealed position. Once the expandable jamb is in its sealed position, the jamb LED 130 is no longer lit and power to motor 88 is disconnected. Then, if electrically actuated drop seals are included in the operable wall system, the drop seals may be activated to drop to their sealed position. During such activation of the drop seals, seals LED 128 is lit. Once the drop seals sealingly engage the floor, seal LED 128 is no longer lit and power moving the drop seals is disconnected. Finally, extend LED 126 is no longer lit.

To retract the wall panels from their extended position to their retracted or stacked position, placement of key switch 122 in the STACK position illuminates retract LED 124. Before moving the wall panels, drop seals 128 are raised during which time seals LED 128 is lit, and then the expandable jamb is moved to its retracted position during which time jamb LED 130 is lit. Movement of the wall panels thereafter causes wall LED 132 to be lit until the panels are in their fully retracted position at which time power driving the walls panels is disconnected.

Figure 11:
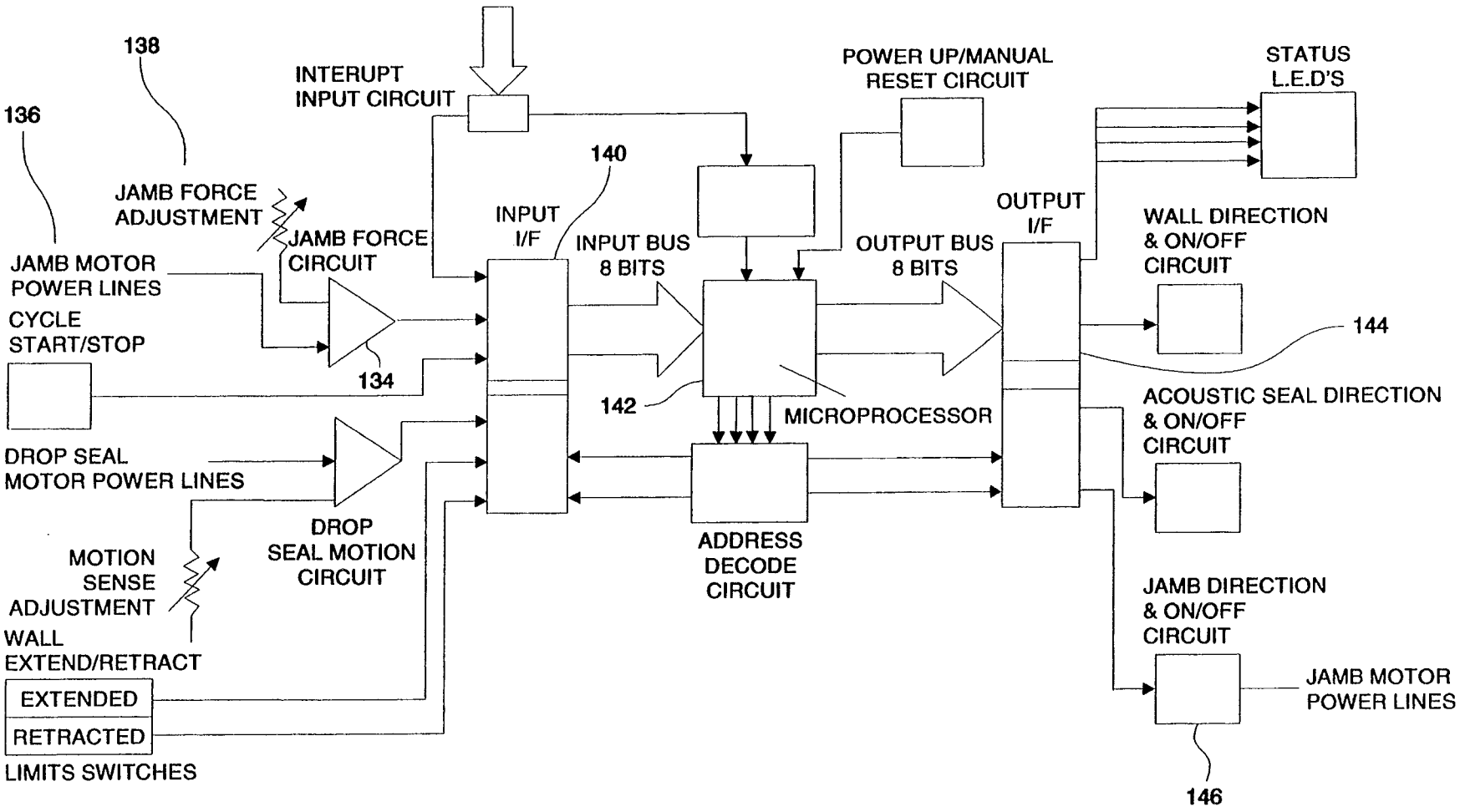
FIG. 11 shows a diagrammatic view of the electronic circuitry used to activate the expandable jamb of the present invention.

Referring now to FIG. 11, there is shown a diagrammatic view of the electronic circuitry accompanying the control box of FIG. 10 and used to activate the expandable jamb of the present invention. The circuitry, illustrated in FIG. 11 may reside primarily within electronic control box 120 illustrated in FIG. 10. As discussed for the embodiment of FIG. 10, the electronic circuitry shown in FIG. 11 may be utilized to move the expandable jamb according to the present invention between its retracted and sealed positions, to raise and lower electrically actuated drop seals, and to stack and extend electrically driven wall panels. Because control of the wall panels is known in the art and control of electrically actuated drop seals is disclosed in the above-mentioned copending application, the focus herein is on the operation of the expandable jamb according to the present invention.

In this embodiment, the electronic circuit includes a means for sensing the pressure applied by the expandable jamb to the adjacent vertical structure when the expandable jamb is in the sealed position, and the circuit includes a means for selecting a desired pressure threshold such that when s the desired threshold is reached, power to motor 88 is disconnected. Specifically, the pressure applied by expandable jamb 54 on the adjacent vertical structure is determined by measuring the current of motor 88. The functions of the controller circuitry illustrated in FIG. 11 are controlled by a microprocessor, such as part no. 68705P3 manufactured by Motorola, Inc. programmed in its machine language, as is explained in greater detail herein.

As previously discussed, power to the expandable jamb of the present invention is to be invoked when either the wall panels have reached their extended position when extending the wall panels, or, when retracting the wall panels, after the drop seals have been retracted. To make these determinations, microprocessor 142 is connected via input interface 140, such as part no. ULN2803 available from Sprague Electronics, to the drop seal motor power lines and the wall extend/retract limit switches as shown in FIG. 11. Once the appropriate condition of either the wall panels or the drop seal has been achieved, microprocessor 142 provides a data signal to output interface 144, such as part no. ULN2803, which in turn provides a jamb signal to jamb direction and on/off circuit 146. In this embodiment, jamb direction and on/off circuit 146 comprises a pair of relays. That jamb signal includes an instruction to turn on jamb motor 88 in the appropriate direction to result in either the expansion or retraction of second wall portion 58 as previously discussed.

It will be appreciated by those of skill in the art that the controller for the expandable jamb of the present invention may not of necessity include all of the elements illustrated in FIG. 11, in terms of the activation of the expandable jamb. For example, rather than being tied together with the operable wall panels or electrically actuated drop seals, a controller may simply be directed toward the expandable jamb and a control box therefor simply comprise a switch having "Extend", "Off" and "Retract" positions for extending the jamb to the sealed position or retracting the jamb from its sealed position. In this manner, the expandable jamb may be utilized with an operable wall system which does not include an electrically actuated drop seal and which is not driven by an electric motor.

Considering the deactivation of motor 88 once the expandable jamb is in the desired position, as shown in FIG. 11, electrically connected to jamb force circuit 134, a voltage comparator, are jamb motor current sense lines 136 and jamb force adjustment 138. Jamb force adjustment 138 serves as a means for selecting the desired threshold voltage representing a desired pressure threshold to be applied to motor 88. Generally, a higher threshold is desired when the expandable jamb according to the present invention is used in conjunction with an operable wall system comprising many wall panels. For example, a threshold voltage of one (1) volt may correspond to a threshold pressure of 100 psi and may be used in conjunction with a five (5) panel operable wall system; two (2) volts may correspond to a threshold pressure of 150 psi and used in conjunction with a fifteen (15) panel system; and four (4) volts may be used with large operable wall systems having a multiplicity of panels. To allow the manufacturer or installer to set the threshold voltage (threshold pressure), various mechanisms well known in the art, such as a potentiometer having an adjustment screw attached thereto, may be utilized.

Jamb force circuit 134 compares the voltage generated by the current sense lines 136 of motor 88 to the threshold voltage selected by jamb force adjustment means 138. The comparative voltage is provided as input to input interface 140 from which the comparative voltage is transmitted as bits to microprocessor 142. Microprocessor 142 evaluates the comparative voltage provided from input interface 140 to determine whether further power is to be provided to motor 88 because the threshold voltage has not yet been reached or if power to motor 88 should possibly be disconnected because the threshold voltage has been achieved. If the threshold voltage has been exceeded, microprocessor 142 does not automatically disconnect power to motor 88 due to the fact that a surge in current of motor 88 may occur when motor 88 has been initially activated to move second wall section 58 toward its retracted or sealed positions. Such a surge is generally present as motor 88 must provide sufficient power to overcome the inertia of second wall section 58. Thus, microprocessor 142 includes a timer which is activated upon receipt of the trigger command to begin to move the expandable jamb and to wait a specified period of time, such as 200 milliseconds, from receipt of the trigger command before disconnecting power to motor 88 in the event a voltage exceeding the threshold voltage has been detected.

To complete the circuitry of the controller with regard to the operation of the expandable jamb of the present invention, commands from microprocessor 142 to either continue to activate motor 88 or to disconnect the power provided to motor 88 are sent to output interface 144. Jamb command signals from output interface 144 are directed to jamb direction & on/off circuitry 146 which is electrically connected to motor 88 via the motors dual power wires.

The pressure sensing means employing the monitoring a motor's current may be used to determine whether the expandable jamb has reached its retracted position in addition to determining whether the expandable jamb is exerting an appropriate force on the vertical surface it engages when in its sealed position. The same threshold pressure, i.e., threshold voltage, may be used for both determinations.

It will be appreciated by those of skill in the art that other mechanisms serving as a pressure sensing means may be utilized to determine whether second wall section 58 has reached the threshold pressure desired for a particular operable wall system. For example, limit switches may be placed along sealing edge 78 of second wall section 58 and electrically connected to a control circuit similar to the one illustrated in FIG. 11. However, to vary the threshold pressure when using limit switches requires adjustment of the limit switches themselves and may not provide the same resolution or control over the threshold pressure as is possible when the current of motor 88 is utilized as an indication of the pressure at sealing edge 78. Further, implementation of limit switches requires electrical connection through movable wall section 58 or, alternately, the use of an infrared or ultrasonic transmitter and receiver for the receipt by the controller of the limit switch signals. Because the control circuit of FIG. 11 is electrically connected to stationary motor 88 attached to first wall section 56, no problems of electrical wiring in a movable wall section, second wall section 58, are encountered and as may be encountered when limit switches are employed. Further, the use of limit switches whether directly wired or connected via an infrared or ultrasonic signal, introduces additional manufacturing costs and potential repair and maintenance problems that are not present in the embodiment of FIG. 11. Finally, separate limit switches or sets of limit switches would be required for the determination of both the retracted and sealed positions of the expandable jamb.

It will be further appreciated that the provision of a means for selecting the voltage threshold allows one to ensure that a good seal results between adjacent panels of operable wall system, between the leading panel and the leading jamb or leading wall, and between the trailing panel and the expandable jamb. In addition, selection of the threshold voltage also assists in ensuring that neither the jamb, the adjacent vertical wall structure, nor the motor within the jamb are damaged by the exertion of excessive forces.

It will be still further appreciated that the provision of a means for determining the pressure exerted by the expandable wall jamb on the adjacent vertical surface assists in ensuring that the wall panels form a flat, solid wall. If sufficient pressure is exerted by the expandable jamb, the use of floor systems in conjunction with some operable wall systems may be minimized or eliminated as the need to support the wall panels against inadvertent forces applied against a panel's exterior surface may no longer be necessary.

The pressure sensing means of the present invention may find other application in the field of operable wall panel systems. For those subsystems employing a motor responsible for the movement of a wall like structure, the pressure sensing means may be utilized. For example, for an electrically driven operable wall system as illustrated in FIG. 2, the pressure sensing means of the present invention may be connected to the wall panel driving motor to ascertain that the wall panels have either reached their fully extended or retracted positions.

The expandable jamb of the present invention may be utilized with operable wall panels which are manually moved into position as well as with continuously hinged, electrically powered wall systems. With the expandable jamb of the present invention installed on one of the two stationary walls in a room between which operable wall panels are themselves to form a wall, the wall panels can be forced together with sufficient pressure to result in a solid wall surface regardless of the means used to place the wall panels in their extended position.

It will be still further appreciated that the expansion mechanism disclosed herein as residing within a wall jamb may also be utilized in an expandable wall panel. Though an expandable jamb is most probably less expensive to manufacture and to maintain due to the fact that the motor in an expandable jamb is in a fixed location, it is conceivable that the expansion mechanism may be affixed to or within a movable panel and power provided thereto.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An expandable wall jamb for an operable wall system, comprising:

a first wall section for connection to a stationary wall, the first wall section having first and second opposing surfaces and an outward edge, the outward edge disposed opposite the stationary wall;

a second wall section having a sealing edge and first and second opposing surfaces substantially parallel to the first and second opposing surfaces of the first wall section, the second wall section movable with respect to the first wall section between a retracted position in which the sealing edge of the second wall section is proximate the outward edge of the first wall section and a sealed position in which the sealing edge of the second wall section is extended away from the outward edge of the first wall section for sealing engagement with a structure spaced from the sealing edge of the second wall section when the second wall section is in its retracted position;

an actuator operatively connected to the first and second wall sections, the actuator movable between a first position and a second position such that when the actuator is in the first position, the second wall section is in the retracted position and when the actuator is in the second position, the second wall section is in the sealed position; and a motor operatively connected to the actuator such that the actuator moves between the first and second actuator positions responsive to the operation of the motor.

2. The jamb of claim 1, further comprising a threaded rod, the threaded rod being rotatable responsive to the operation of the motor; and wherein the actuator comprises a nut threadedly engaging the threaded rod and axially movable along the threaded rod between the first and second actuator positions upon rotation of the shaft, and a tube having two ends, the tube connected to the nut at one of its ends.

3. The jamb of claim 2, further comprising a connector for connection of the actuator to the second wall section, and an actuator bracket rigidly connected to the first wall section; and wherein the actuator further comprises a first extension arm having two ends, the first extension arm being pivotally connected to the tube at one of its ends and pivotally connected to the connector at its other end, and a second extension arm having two ends, the second extension arm pivotally connected at one of its ends to the actuator bracket and pivotally connected at its other end to the first extension arm between the first extension arms ends.

4. The jamb of claim 1, further comprising means for selecting the actuator position, the selecting means in electrical connection with the motor such that selection of an actuator position causes activation of the motor to move the actuator to the selected position.

5. The jamb of claim 1, further comprising means for sensing the pressure exerted on the sealing edge of the second wall section by the structure, the pressure sensing means operatively connected to the motor such that power to the motor is disconnected when the pressure sensed reaches a predetermined pressure threshold.

6. The jamb of claim 5, wherein the pressure sensing means comprises a voltage comparator electrically connected to the motor for comparing the voltage of the current sense lines of the motor to a predetermined voltage threshold corresponding to the predetermined pressure threshold.

7. The jamb of claim 5, further comprising means for selecting the predetermined threshold.

8. An operable wall panel system for disposition in a room having a ceiling and two opposing wall surfaces, the wall system comprising:

a track operatively connected to the ceiling between the opposing wall surfaces, the track defining a track path;

a plurality of wall panels operatively connected to and movable along the track path; and an expandable jamb connected to one of the opposing wall surfaces, the expandable jamb comprising a first wall section for connection to a stationary wall, the first wall section having first and second opposing surfaces and an outward edge, the outward edge disposed opposite the stationary wall, a second wall section having a sealing edge and first and second opposing surfaces substantially parallel to the first and second opposing surfaces of the first wall section, the second wall section movable with respect to the first wall section between a retracted position in which the sealing edge of the second wall section is proximate the outward edge of the first wall section and a sealed position in which the sealing edge of the second wall section is extended away from the outward edge of the first wall section for sealing engagement with a structure spaced away from the sealing edge of the second wall section when the second wall section is in its retracted position, an actuator operatively connected to the first and second wall sections, the actuator movable between a first position and a second position such that when the actuator is in the first position, the second wall section is in the retracted position and when the actuator is in the second position, the second wall section is in the sealed position, and a motor operatively connected to the actuator such that the actuator moves between the first and second actuator positions responsive to the operation of the motor.

9. The operable wall system of claim 8, further comprising a threaded rod, the threaded rod being rotatable responsive to the operation of the motor; and wherein the actuator comprises a nut threadedly engaging the threaded rod and axially movable along the threaded rod between the first and second actuator positions upon rotation of the shaft, and a tube having two ends, the tube connected to the nut at one of its ends.

10. The operable wall system of claim 9, further comprising a connector for connection of the actuator to the second wall section, and an actuator bracket rigidly connected to the first wall section; and wherein the actuator further comprises a first extension arm having two ends, the first extension arm being pivotally connected to the tube at one of its ends and pivotally connected to the connector at its other end, and a second extension arm having two ends, the second extension arm pivotally connected at one of its ends to the actuator bracket and pivotally connected at its other end to the first extension arm between the first extension arms ends.

11. The operable wall system of claim 8, further comprising means for selecting the actuator position, the selecting means in electrical connection with the motor such that selection of an actuator position causes activation of the motor to move the actuator to the selected position.

12. The operable wall system of claim 8, further comprising means for sensing the pressure exerted on the sealing edge of the second wall section by the structure, the pressure sensing means operatively connected to the motor such that power to the motor is disconnected when the pressure sensed reaches a predetermined pressure threshold.

13. The operable wall system of claim 12, wherein the pressure sensing means comprises a voltage comparator electrically connected to the motor for comparing the voltage of the current sense lines of the motor to a predetermined voltage threshold corresponding to the predetermined pressure threshold.

14. The operable wall system of claim 12, further comprising means for selecting the predetermined threshold.

15. The operable wall system of claim 8, wherein the plurality of wall panels are hingedly connected to each other, the wall system further comprising:

a drive motor operatively connected to one of the wall panels such that the wall panels are collectively moved along the track path in response to the operation of the drive motor.

* * * * *